United States Patent [19]

Shrader

[11] 4,277,718

[45] Jul. 7, 1981

[54] MODULAR ELECTRON TUBE WITH CARBON GRID

[75] Inventor: Merrald B. Shrader, Los Altos, Calif.

[73] Assignee: Varian Associates, Inc., Palo Alto, Calif.

[21] Appl. No.: 92,124

[22] Filed: Nov. 7, 1979

[51] Int. Cl.[3] ..... H01J 1/46; H01J 21/10

[52] U.S. Cl. ..... 313/304; 313/293; 313/296; 313/302; 313/348

[58] Field of Search ..... 313/304, 302, 348, 293, 313/296

[56] References Cited

U.S. PATENT DOCUMENTS

| | | | |
|---|---|---|---|
| 2,817,031 | 12/1957 | Bennett | 313/348 X |
| 2,853,640 | 9/1958 | Hoover | 313/304 X |
| 3,307,063 | 2/1967 | Sarrois | 313/348 |
| 3,544,831 | 12/1970 | Hammersand et al. | 313/293 |
| 3,863,163 | 1/1975 | Farrell et al. | 313/304 |
| 4,011,481 | 3/1977 | Preist | 313/304 |
| 4,121,130 | 10/1978 | Gange | 313/302 |

*Primary Examiner*—Saxfield Chatmon, Jr.
*Attorney, Agent, or Firm*—Stanley Z. Cole; Leon F. Herbert; Richard B. Nelson

[57] ABSTRACT

In a high-power grid-controlled electron tube, a common anode receives electrons from a modular electron source having a common support structure to which are attached a plurality of modules. Each module has at least one cathode and grid mounted on a base which is individually attached to the support structure. The grids are approximately flat sheets of carbon with apertures to pass the electrons. Pyrolytic graphite is a preferred grid material.

12 Claims, 5 Drawing Figures

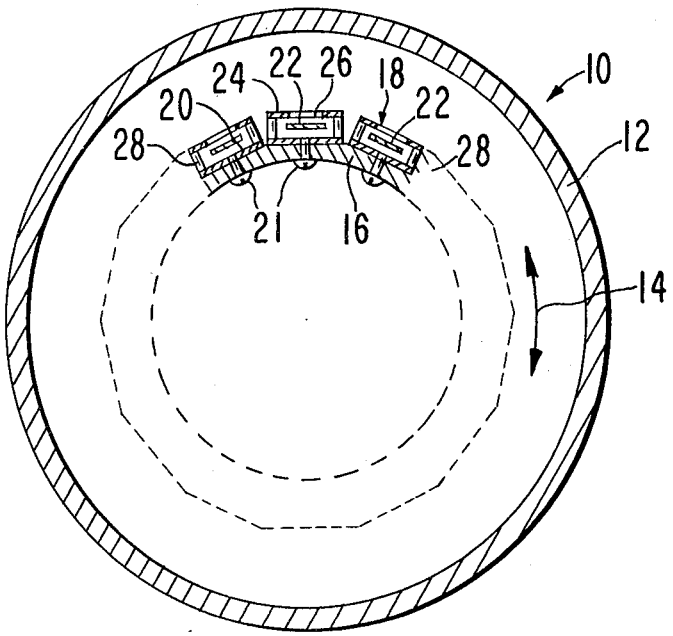
FIG. 1
FIG. 2
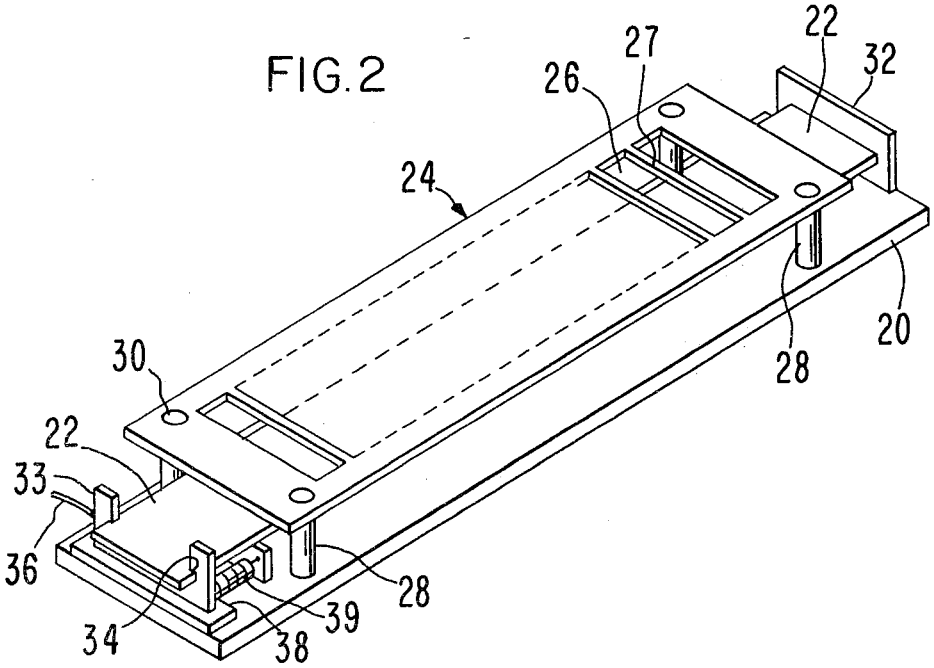

FIG.3
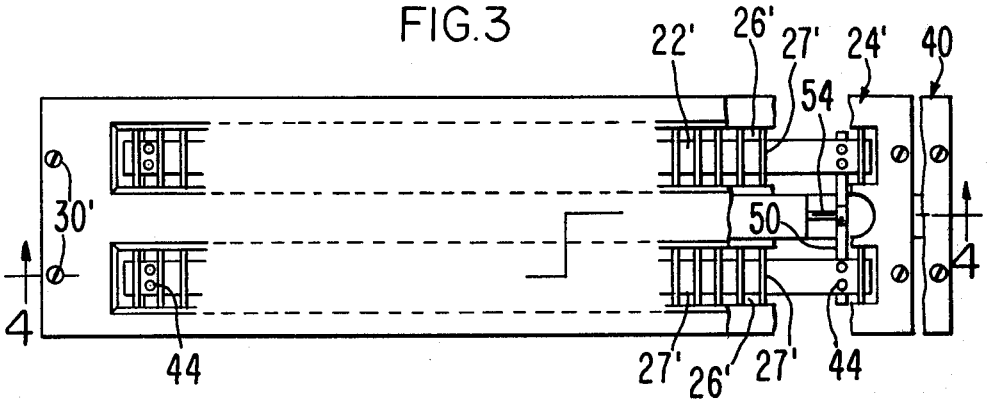
FIG.4
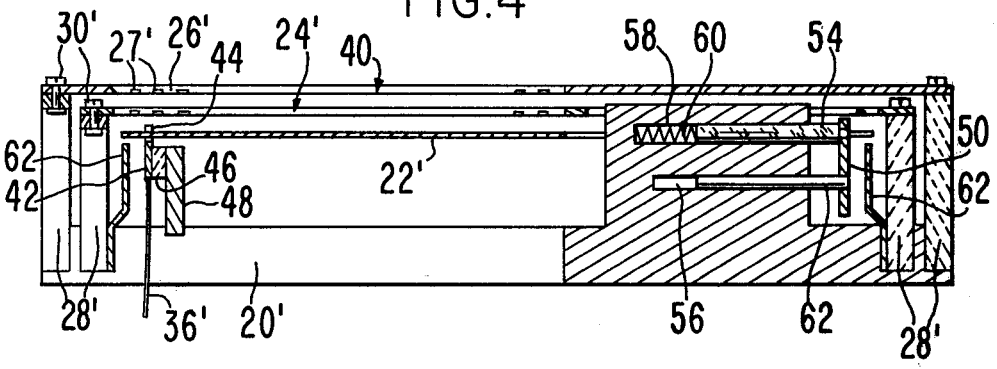
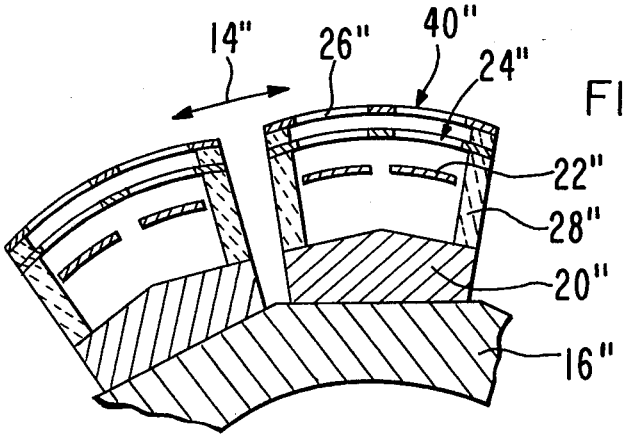
FIG.5

MODULAR ELECTRON TUBE WITH CARBON GRID

FIELD OF THE INVENTION

The invention pertains to high-power grid-controlled electron tubes. Such tubes are sometimes constructed as the electrical equivalent of a multiplicity of small tubes in parallel inside a single vacuum envelope.

PRIOR ART

An old problem is to increase the power-handling capacity of a grid-controlled tube while maintaining a small interelectrode spacing needed for low voltage and high frequency operation. If the areas of the electrodes are simply made larger, the problems of variable electrode spacing and mechanical deformation become severe. An early improvement was to simply mount a plurality of sets of tube electrodes inside a common vacuum envelope, the individual sets of cathodes, grids and anodes being connected in parallel. The result was somewhat cheaper than the equivalent set of individual tubes externally connected in parallel. Also, the lengths of connecting leads was reduced, providing greater freedom from parasitic oscillations and capability for higher frequency operation.

A further improvement came with the realization that it was not necessary to have a separate anode for each grid-cathode cell. Because the anode has greater spacing and is structurally simple, it can be a common electrode receiving electrons from a multiplicity of individually separated grid-cathode units. U.S. Pat. No. 2,853,640 issued Sept. 23, 1958 to M. V. Hoover describes such a tube. Individual ribbon cathodes are held in recesses in a massive metal cylinder. A wire grid is wound around the cylinder to form areas of current-modulating grids where it crosses the recess openings. This construction permitted close control of grid-cathode spacing. However, it is very costly, requiring precise hand-assembly of many parts. Also, if any one unit cell fails in manufacture or use, the entire tube is ruined.

U.S. Pat. No. 4,011,481 issued Mar. 8, 1977 to Donald H. Preist and co-assigned with the present invention describes a further improvement. Individual modules are built, each containing a single cathode and grid. The modules are then attached to a common mount to form a grid-cathode electron source which is then mounted within a common anode. Preist's structure allowed the grid-cathode modules, which embody the critical spacings, to be mass produced as identical elements and individually inspected and tested before assembly in the common tube structure. Preist describes round wire cathode filaments. He does state that other cross-sections can be used but does not teach any advantage in doing so.

Other prior art, unrelated to the modular concept, concerns the materials and structures of grids. As is well known, grids should have low secondary and thermionic emission when contaminated with active material from the cathode. It is also well known that carbon has these excellent properties, and also a high coefficient of thermal radiation making it run cool. There is much art published on coating metallic grid wires with carbon or metal carbides. Recently, schemes for making grids from a single piece of pyrolytic graphite have been used, taking advantage of the excellent conductivity in the directions parallel to the deposition base. U.S. Pat. No. 3,307,063 issued Feb. 28, 1967 to J. M. Sarrois describes such a scheme. Prior-art gridded power tubes have been built with cylindrical anode configuration, so the graphite blank from which the grids are cut had to be formed on a cylindrical mandrel. This is a very expensive process and it has proven very difficult to make the pyrolytic graphite cup of uniform and controlled thickness.

SUMMARY OF THE INVENTION

An object of the invention is to provide a high-power grid-controlled electron tube which is cheap and easy to manufacture.

A further object is to provide a tube in which electrode spacings are accurately controlled.

A further object is to provide a tube in which grid-cathode dimensions may be tested before final assembly.

A further object is to provide a tube with low grid emission.

A further object is to provide a tube with long electrical leakage paths between electrodes.

These objects are achieved by assembling the electron source from a plurality of pre-assembled grid-cathode modules. Each module has at least one cathode with a flat emissive surface and a flat or slightly curved grid made of carbon, preferably pyrolytic graphite. Flat sheets of pyrolytic graphite are cheap and of accurate thickness.

BRIEF DESCRIPTION OF THE DRAWINGS

FIG. 1 is a schematic section of a triode embodying the invention.

FIG. 2 is a schematic isometric view of a single grid-cathode module.

FIG. 3 is a plan view of a module with hairpin filaments.

FIG. 4 is a cross-sectional view taken along lines 4—4 of FIG. 3.

FIG. 5 is a schematic section of a tetrode embodying the invention, having curved electrodes.

DESCRIPTION OF THE PREFERRED EMBODIMENTS

FIG. 1 is a very schematic illustration of the essence of the invention. It is a sectional view, perpendicular to the axis, of a triode 10 whose electrode structures are grossly arranged as coaxial right circular cylinders. The anode of tube 10 comprises a hollow, cylindrical, thick-walled metallic tube 12, as of copper. Inside anode 12, and supported from it by a dielectric portion of the vacuum envelope (not shown) is the electron source structure 14, comprising a common support member 16 to which are attached a plurality of individual grid-cathode modules 18. Each module 18 has its own mounting member 20 as of copper with screws 21 for attaching to common support member 16.

A ribbon-shaped cathode 22, as of thoriated tungsten, elongated in the axial direction perpendicular to the section, is supported from mounting member 20 by means (not shown) whereby at least one end is insulated from support member 16. Outside cathode 22 is a flat grid 24 having apertures 26 opposite the emissive flat surface of cathode 22 to permit passage of electron current to anode 12. Grids 24 are supported on mounting member 20 by insulators 28. Leads (not shown) are provided for interconnecting grids 24 and cathodes 22 of all modules 18 to common terminals with insulated seals through the vacuum envelope as is well known in the art.

Grids 24 are formed of flat graphite sheets to provide low thermionic and secondary emission of electrons and a black surface for good thermal radiation and consequent low operating temperature. An advantageous grid material is pyrolytic graphite which is readily obtainable in flat sheets. The inventive structure thus eliminates the need to make complete cylinders of pyrolytic graphite as was done in the prior art. These cylinders have proven to be very expensive because they must be made by a carefully controlled batch process. Also keeping their wall thickness uniform is very difficult. The flat sheets on the other hand are uniform and cheap and easy to fabricate. The graphite sheets are perforated by a cutting punch, abrasion, laser cutting or ultrasound. Pyrolytic graphite has very high thermal and electrical conductivity in the plane of the sheet, which is advantageous for cooling the grid by conduction. Also, the thermal expansion in the plane of the sheet is very low, so differential expansion between grid 24 and mounting member 20 is minimized.

FIG. 2 illustrates an exemplary mechanical construction of a module 18. Grid 24 is perforated with a row of rectangular apertures 26 separated by carbon web members 27. It is fastened by screws or rivets 30 to insulating posts 28 which are attached to module mounting member 20. Insulators 28 may be near the ends of the module as shown, or alternatively they may be at the center, leaving grid 24 projecting as a free-standing beam. The latter arrangement allows grid 24 to expand thermally without any tendency to buckle, but is a less firm support. Cathode ribbon 22 is supported parallel to grid 24 and slightly beneath it. A conductive support 32 at one end, as of molybdenum, passes cathode heating current to mounting member 20. The other end of cathode 22 is supported by a second conducting support member 33, as of tungsten, which interlocks with notches 34 in cathode ribbon 22. A flexible lead 36 supplies heating current to support member 33 and thence cathode 22. Support member 33 is attached to an insulating block 38 as of alumina ceramic which is slidably keyed to mounting member 20 to allow thermal expansion of filament 22. A compression spring 39 provides a slight tension in filament 22.

FIG. 3 is a top view and FIG. 4 a staggered frontal section of a tetrode module containing a pair of cathode filaments in a hairpin arrangement which improves the heating-current connections and the expansion spring mechanics. As in the single-filament module of FIG. 2, the components of the module are mounted on a support block 20' which is adapted to be attached, as by screws (not shown) to a common support member (16, FIG. 1). The module of FIGS. 3, 4 is an electron source for a tetrode, having a control grid 24' in front of the cathode ribbons 22' and a screen grid 40 of similar construction. Each grid 24', 40 is cut from a single sheet of carbon and has two rows of apertures 26' separated by web members 27', each row being aligned above one of the parallel filament ribbons 22'. Alternatively, a single row of wider apertures may be used to cover both filaments. Grids 24'' are attached to support block 20' by screws 30' and insulators 28', as of alumina ceramic, which are elongated to provide long leakage paths. One end of each of filaments 22' is held fixed by a separate conductive support tab 42 having a pair of teeth 44 projecting through holes in filament ribbon 22'. Tabs 42 are mounted via insulators 46 on a projecting block 48 of support member 20'. Supply leads 36' deliver heating current to filaments 22' which are connected in series at their other ends by a jumper support tab 50 having teeth 44 similar to those on tabs 42. Jumper tab 50 is guided by a pair of ceramic rods 52, 54 so that it is free to slide axially, thus allowing cathode filaments 22' to expand as they are heated. Rods 52, 54 are aligned by holes 56, 58 in support block 20'. A compression spring 60 in hole 58 provides a tensile force exactly in the plane of filaments 22' and exactly between them to keep filaments 22' straight. With the series connection of filaments 22' no heater current lead is needed at the movable ends, so the problem of flexible current leads is eliminated. A pair of metallic shields 62 prevents material evaporated from filaments 22' from depositing on grid insulators 28' and causing current leakage.

FIG. 5 is a schematic section perpendicular to the axis of a slightly different embodiment. Here the filaments 22'' and grids 24'', 40'' are slightly curved into sections of right circular cylinders. This provides better mechanical stability than flat sheets which may tend to buckle under thermal expansion. Also, the composite electron source structure 14'' has a shape more nearly approximating a right circular cylinder, which may make the electron optics of the tube somewhat better.

The above-described embodiments are intended to be only examples to illustrate the invention. It will be obvious to those skilled in the art that many variations of the carbon-gridded module may be made within the true scope of the invention. The cathode filaments may not be ribbons with rectangular cross section, but may take any elongated cylindrical shape. (A cylinder being the closed surface traced by a straight line moving parallel to another straight line.) Besides the curved cylinders of FIG. 5, the filaments may have a concave curvature of their emitting sides to focus electrons through the grids. Also, instead of being ribbons, they may be right circular cylinders with flattened-off emissive sides. The invention is intended to be limited only by the following claims and their legal equivalents:

I claim:

1. In an electron tube, an anode, and an electron source assembly comprising:

a common support member insulated from said anode, a plurality of grid-cathode modules, each comprising at least one thermionic cathode having a substantially flat emissive surface, at least one grid formed of a substantially flat sheet of carbon with openings for passage of electrons, and mounting means for supporting said cathode and said grid in insulated spaced relationship to each other to form said module such that said sheet is positioned substantially parallel to said emissive surface, said mounting means of each module being independent of the mounting means of the other modules, means for affixing said mounting means independently to said common support member such that said emissive surfaces face said anode, and said grids are between said emissive surfaces and said anode, means for electrically connecting said cathodes to a common terminal, and means for electrically connecting said grids to a common terminal.

2. The tube of claim 1 wherein said grid is formed of a sheet of pyrolytic graphite.

3. The tube of claim 1 wherein the surface of said cathode is an elongated cylinder.

4. The tube of claim 3 wherein said means for heating comprises means for passing current through said cathode.

5. The tube of claim 4 wherein each module comprises at least one pair of adjacent, parallel cathodes and said means for passing current comprises means for passing current through a first of said pair in one direction and serially through the second of said pairs in the opposite direction.

6. The tube of claim 5 further including spring means attached to the ends of said pair of cathodes which are electrically connected together, said spring means being flexible to permit expansion of said cathodes in the direction of the generators of said cylinders.

7. The tube of claim 6 wherein said spring means are sprung to provide tension in said cathodes in said direction of said generators.

8. The tube of claim 1 wherein said each module further comprises a second grid disposed substantially parallel to said one grid and on the opposite side of said one grid from said emissive surface.

9. The tube of claim 1 wherein said means for mounting said cathode and said grid comprises a frame member adapted to be affixed to said common support and at least one stand-off insulator supporting said grid from said frame.

10. The tube of claim 1 wherein said means for mounting said cathode and said grid comprises a frame member adapted to be affixed to said common support and at least one stand-off insulator supporting said cathode from said frame.

11. The tube of claim 3 wherein said anode has a first right circular cylindrical surface facing said grid and said modules are mounted on said common support so that said emissive surfaces lie approximately on the surface of a second right circular cylinder coaxial with said first cylinder.

12. The tube of claim 3 wherein the emissive surface of said cathode is slightly convex and said grid sheet is curved to conform to said emissive surface.

* * * * *